US009311906B2

(12) United States Patent
Zeng

(10) Patent No.: US 9,311,906 B2
(45) Date of Patent: Apr. 12, 2016

(54) ELECTRONIC ORGAN WITH FREE-COMBINED KEYS AND A METHOD TO REALIZE FREE COMBINATION

(71) Applicant: Shenzhen Innoplay Network & Technology Co., Ltd., Shenzhen, Guangdong Province (CN)

(72) Inventor: Xianzhi Zeng, Shenzhen (CN)

(73) Assignee: SHENZHEN INNOPLAY NETWORK & TECHNOLOGY CO., LTD, Shenzhen, Guangdong Province (CN)

( * ) Notice: Subject to any disclaimer, the term of this patent is extended or adjusted under 35 U.S.C. 154(b) by 0 days.

(21) Appl. No.: 14/519,913

(22) Filed: Oct. 21, 2014

(65) Prior Publication Data

US 2016/0063981 A1 Mar. 3, 2016

(30) Foreign Application Priority Data

Aug. 27, 2014 (CN) ..... 2014 1 0427820

(51) Int. Cl.
*G10H 1/32* (2006.01)
*G10H 3/00* (2006.01)
*G10H 1/34* (2006.01)

(52) U.S. Cl.
CPC ..... *G10H 1/346* (2013.01)

(58) Field of Classification Search
CPC ..... G10H 1/344; G10H 2220/221; G10H 2220/256; G10H 1/32; G10H 1/346
USPC ..... 84/744
See application file for complete search history.

(56) References Cited

U.S. PATENT DOCUMENTS

| | | | | |
|---|---|---|---|---|
| 4,147,085 | A * | 4/1979 | Robinson et al. | 84/682 |
| 4,408,517 | A * | 10/1983 | Ellen | 84/345 |
| 4,516,465 | A * | 5/1985 | Kani | 84/470 R |
| 6,259,006 | B1 * | 7/2001 | Parienti | 84/171 |
| 6,875,913 | B2 * | 4/2005 | Bubar | 84/423 R |
| 7,465,868 | B2 * | 12/2008 | Lengeling | 84/719 |
| 7,977,561 | B2 * | 7/2011 | Folkesson | 84/615 |
| 8,952,232 | B2 * | 2/2015 | Parsons et al. | 84/429 |
| 2005/0241467 | A1 * | 11/2005 | Lo | 84/744 |
| 2013/0068085 | A1 * | 3/2013 | Yoshikawa | 84/645 |
| 2014/0260908 | A1 * | 9/2014 | Yoshikawa | 84/609 |

* cited by examiner

*Primary Examiner* — Jeffrey Donels
(74) *Attorney, Agent, or Firm* — KIng & Schickli, PLLC

(57) ABSTRACT

The present invention discloses a kind of electronic organ with free-combined keys and the method to realize free combination of key groups. The electronic organ comprises host processor and key groups. The method includes steps: S1, Connect freely combined key groups to the electronic organ; S2, The host processor obtains the number of the key groups, address information and locations of keys in key groups; S3, The host processor sets the function or scale for each key according the number of key groups, address information and locations of keys in key groups. The present invention realizes free combination and disassembly of key groups by a method recognizing the free-combined key groups. It makes miniaturization and portability of electronic organ possible and strengthens user experience. Its structure is simple and it brings good economic and social benefits. The present invention can be applied to a variety of electronic organs.

8 Claims, 2 Drawing Sheets

ELECTRONIC ORGAN WITH FREE-COMBINED KEYS AND A METHOD TO REALIZE FREE COMBINATION

FIELD OF INVENTION

This invention relates to the field of electro-acoustic musical instrument, especially relates to an electronic organ with free-combined keys. The present invention also relates to a method to realize free combination of the keys of electronic organ.

BACKGROUND OF THE INVENTION

UART: Universal Asynchronous Receiver/Transmitter is used to control a computer and serial device.

$I^2C$: Inter-Integrated Circuit is a two-wire serial bus developed by PHILIPS Company for connecting the microcontroller and its peripheral equipment. It is a bus standard widely used in the field of microelectronics communication control. It is a special form of synchronous communication featured with less interface cables, simple control method, small instrument packaging and higher communication speed.

The electronic organ is a keyboard instrument. It is in fact an electronic synthesizer. It adopts large scale integrated circuit and most of them are provided with sound memory (wavetable). It is used to store real sound waveforms of all kinds of musical instruments and output them during playing.

In known technologies, most of the keys of the electronic organ are arranged in fixed pattern. Their number of keys and functions are pre-determined in the factory. But the number of keys or function buttons varies according to the occasions they are used or the needs of the players. The keys or function buttons of the electronic organ cannot be disassembled or assembled freely as required by the user. They are not easy to use or convenient to carry, thus affecting user experience.

SUMMARY OF THE INVENTION

In order to solve these technical problems, the present invention is to provide an electronic organ whose keys are available for free combination and can be assembled or disassembled as wanted.

In order to solve these technical problems, the other objective of this invention is to provide a method to realize free combination of keys of electronic organ.

The technical solutions in the present invention are:

A kind of electronic organ with free-combined keys comprises host processor and key groups, wherein, the key groups comprise keys, the first interface that accesses to host processor or previous key group and the second interface that connects to next key group, making the key groups to be combined freely.

Preferably, said key groups includes sub-processors and the keys connect to sub-processors, said sub-processors connect to host processor or previous key group via the first interface.

Preferable, the said first interface includes the first port and the first $I^2C$ bus interface, the said second interface includes the second port and the second $I^2C$ bus interface, wherein, the first port and the second port connect to sub-processors, $I^2C$ bus interface connect to sub-processors and the second $I^2C$ bus interface respectively; the first port is used to connect to the second port of previous key group or the host processor; the first $I^2C$ bus interface is used to connect to the second $I^2C$ bus interface of previous key group or the host processor.

Preferably, it also includes an audio input and output module wherein the audio input and output module includes audio input interface, power amplifier circuit and speakers, wherein the power amplifier circuit's output terminal connects with the speakers and the output terminal of audio input interface connects with the input terminal of the power amplifier circuit, the output terminal of host processor is connected with input terminal of the power amplifier circuit.

Preferably, the said key groups also include LED light module wherein the LED module includes LED driver and LED lights and the output terminal of sub-processors connect with LED driver and LED lights in turns.

Preferably, it also includes a power supply module for the electronic organ.

Preferably, it also includes a Bluetooth module wherein the Bluetooth module connects with host processor.

A method to realize free combination of electronic organ keys includes the following steps: S1, Connect freely combined key groups to the electronic organ; S2, The host processor obtains the number of the key groups, address information and locations of keys in key groups; S3, The host processor sets the function or scale for each key according the number of key groups, address information and locations of keys in key groups.

Preferably, said step S2 includes: S21, host processor obtains number of key groups that are accessed to the electronic organ via the port. S22, the host processor obtains the key group address information and key location in the key group via $I^2$ C bus.

Preferably, said step S21 includes: the host processor sends instructions with group number information to the key group connected to it via port line. After the key group receives the instruction from host processor, it adds 1 to the number information and sends it to next group and so on until reaching the last key group. The transmitting terminal and receiving terminal of the port in last key group are in short circuit, i.e. the last key group receives the group number information from the receiving terminal and recognizes itself the last key group, then it replies its group number to previous key group. Every key group replies the previous group the instruction with group number information of the last key group. At last, the host processor receives group number instruction to recognize the number of key groups that are connected to the electric organ.

The benefit of the present invention:

The present invention is a kind of electronic organ which realizes free combination and disassembly of key groups through the use of host processor, key groups and interfaces in the key groups. Therefore, the miniaturization and portability of the electronic organ are realized and the user experience is strengthened. It also has simple structure, having good economic and social benefits.

Another benefit of the present invention is:

The present invention provides a method for free combination and recognition of key groups which realizes free combination and disassembly of key groups. Therefore, the miniaturization and portability of the electronic organ are realized and the user experience is strengthened. It also has simple structure, having good economic and social benefits.

The present invention can be applied to a variety of electronic organs.

DESCRIPTION OF THE FIGURES

The embodiments of the present invention are further illustrated by using the accompanying.

DETAILED DESCRIPTION OF THE INVENTION

Please note that the embodiments and characteristics of the embodiments in this application can be combined with each other in case no conflict arising therefrom.

Figure 1:
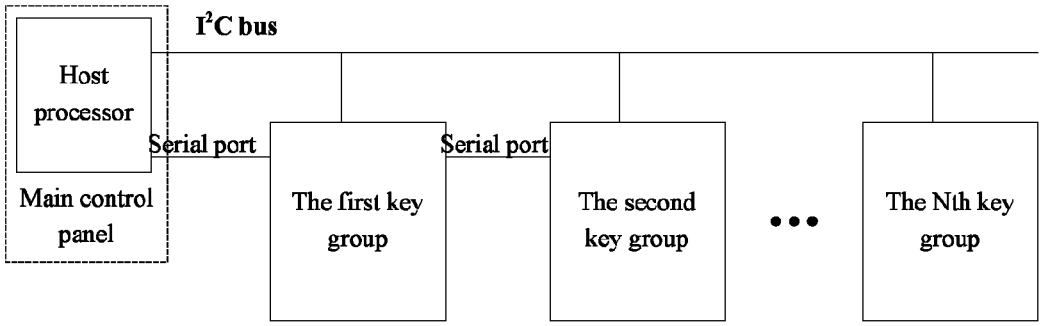
FIG. 1 shows a schematic diagram of one embodiment of the electronic organ with free-combined keys.
Figure 2:
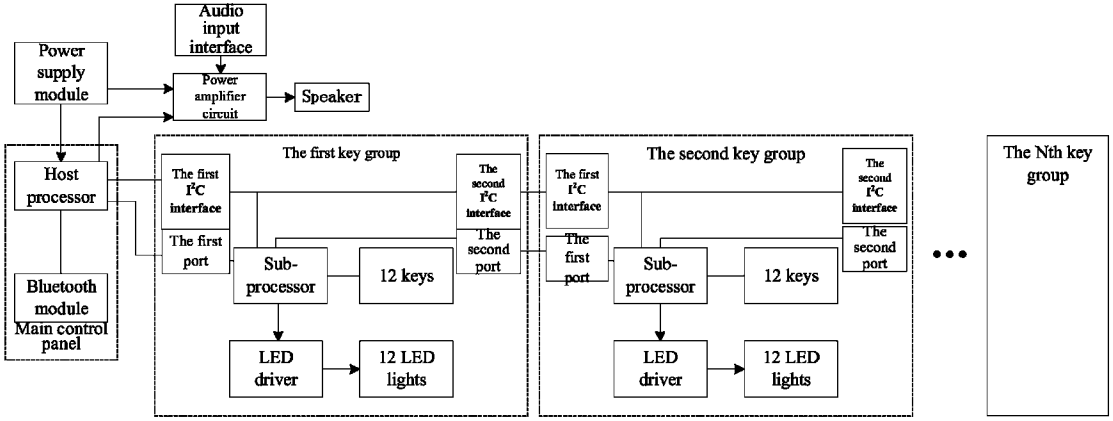
FIG. 2 show a circuit configuration of one embodiment of the electronic organ with free-combined keys.

As shown in FIG. 1 and FIG. 2, a kind of electronic organ with free-combined keys includes host processor and key groups, wherein the said key groups includes keys, the first interface to access to host processor or previous key group and the second key group to access to next key group, which realizes free combination of key groups. In this embodiment, every key group has 12 keys while the number of keys can be set as required.

The said key group also comprises sub-processor. Said keys are connected to the sub-processor. Said sub-processor connects to host processor or previous key groups via the first interface. In this embodiment, all 12 keys of the key group connect to sub-processor.

This first interface comprises the first port and the first $I^2C$ bus interface; the said second interface comprises the second port and the second $I^2C$ bus interface; wherein the first port and the second port connect with sub-processors, the first $I^2C$ bus interface connects with sub-processor and the second $I^2C$ bus interface respectively, this first port is used to access to the second port of previous key group or host processor, this first $I^2C$ bus interface is used to access to the second $I^2C$ bus interface of previous key group or the host processor. In this embodiment, both the first port and the second port are UART ports having transmitting terminal and receiving terminal.

The host processor can recognize the number of key groups that connect to it by using the first port, the second port and their connection relationship. The structure that the second port adopts is: When no further key group is connected to it, the transmitting terminal and receiving terminal of the second port are shorted out; When there is key group connecting to it, the transmitting terminal and receiving terminal of the second port disconnect and respectively connect to the transmitting terminal and receiving terminal of previous key group. This structure is realized by short circuit structure which is not described here. The basic principle of recognition is: The host processor sends instructions with group number information to the key group that is connected to it via UART serial port line. When the key group receives the instructions from the host processor, it adds 1 to the group number instruction and sends it to the next key group and so on until the last key group. Because the transmitting terminal and receiving terminal of UART serial port in last key group are connected to each other, it receives the instruction with its group number information and recognizes that it is the last group. Then it replies to the previous key group its group number. Every key group replies to the previous one the group number of the last key group. At last, the main processor receives the group number instruction and recognizes the number of key groups that are connected to the electronic organ. For example, when 6 key groups are connected, group number information of each key group (from left to right) is:

1→2→3→4→5→6

6←6←6←6←6←6←6←6.

The host processor obtains key group address information and key locations in each group by using $I^2C$ bus addressing mode, to define the scales and determine the locations of keys. The realization principle is: When the key groups are connected to the electronic organ, the host processor is used as the host and the key groups are slaves. The key groups set its $I^2C$ slave address according to the sequence identified by serial ports. Taking the 6 key group above for example, the key group can set its $I^2C$ slave address as "Group number *2". Then the $I^2C$ slave addresses of 6 key groups are: 2, 4, 6, 8, 10, 12. It can set key groups with small address values as low pitch zone and key groups with high address values as high pitch zone. When a key is depressed, $I^2C$ bus transmits its location information to host processor which responses according to scale definition or functional definition.

In this embodiment, the electronic organ also includes audio input and output modules, wherein, the said audio input and output modules include audio input interface, power amplifier circuit and speakers. The said power amplifier circuit's output terminal is connected to the speakers. The output terminal of said audio input interface is connected to the input terminal of power amplifier circuit. The said main processor's output terminal is connected to the input terminal of said power amplifier circuit. In this embodiment, the audio input interface adopts standard 3.5 mm audio input interface. The speakers includes a left speaker and a right speaker which are placed at left and right ends of the electronic organ and connected to the output terminal of power amplifier circuit.

Preferably, the said key groups also include LED light module wherein the LED module includes LED driver and LED lights and the output terminal of sub-processors connect with LED driver and LED lights in turns. LED driver adopts IS31FL3730, the audio mode matrix LED driver. In this embodiment, the LED light in a key group corresponds to 12 keys. The LED light turns on according to the music signal, indicating that the corresponding key shall be pressed. It can facilitate the use and learning process. LED driver adopts audio module matrix LED driver IS31FL3730. In this embodiment, the LED lights in a key group corresponding to 12 keys and they are lit responding to musical signals to indicate that corresponding keys shall be pressed. This design facilitates the user's learning and using experiences.

Preferably, it also includes a power supply module for the electronic organ. The power supply module supplies power to control panel and power amplifier circuit.

Preferably, it also includes a Bluetooth module wherein the Bluetooth module connects with host processor. The Bluetooth module can realize communication with peripheral equipment. For example, it can connect with cell phone or PAD to play music in peripheral equipment or send key signal to peripheral equipment.

The present invention is a kind of electronic organ which realizes free combination and disassembly of key groups through the use of host processor, key groups and interfaces in the key groups. Therefore, the miniaturization and portability of the electronic organ are realized and the user experience is strengthened. It also has simple structure, having good economic and social benefits.

A method to realize free combination of keys of electronic organ is applied to the electronic organ with free-combined keys. This method includes steps: S1, Connect freely combined key groups to the electronic organ; S2, The host processor obtains the number of the key groups, address information and locations of keys in key groups; S3, The host processor sets the function or scale for each key according the number of key groups, address information and locations of keys in key groups.

Preferably, said step S2 includes: S21, host processor obtains number of key groups that are accessed to the electronic organ via the port. S22, the host processor obtains the key group address information and key location in the key group via $I^2C$ bus.

Preferably, said S21 is: the host processor sends instructions with group number information to the key group connected to it via port line. After the key group receives the instruction from host processor, it adds 1 to the number information which is sent to next group and so on until the last key group. The transmitting terminal and receiving terminal of the port in last key group are in short circuit, i.e. the last key group receives the group number information from the receiving terminal and recognizes itself the last key group, then it replies its group number to previous key group. Every key group replies the previous group the instruction with group number information of the last key group. At last, the host processor receives group number instruction to recognize the number of key groups that are connected to the electric organ.

For example, when 6 key groups are connected, group number information of each key group (from left to right) is:

1→2→3→4→5→6

6←6←6←6←6←6←6←6.

The host processor obtains key group address information and key locations in each group by using $I^2C$ bus addressing mode, to define the scales and determine the locations of keys. The step to realize it is: When the key groups are connected to the electronic organ, the host processor is used as the host and the key groups are slaves. The key groups set its $I^2C$ slave address according to the sequence identified by serial ports. Taking the 6 key group above for example, the key group can set its $I^2C$ slave address as "Group number *2". Then the $I^2C$ slave addresses of 6 key groups are: 2, 4, 6, 8, 10, 12. It can set key groups with small address values as low pitch zone and key groups with high address values as high pitch zone. When a key is depressed, $I^2C$ bus transmits its location information to host processor which responses according to scale definition or functional definition.

The present invention provides a method for free combination of electronic organ keys. Free combination and disassembly of key groups are realized via the recognition method of key groups. It makes miniaturization and portability of electronic organ possible and strengthens user experience. Its structure is simple and it brings good economic and social benefits. The present invention can be applied to a variety of electronic organs.

These are preferred embodiments of the present invention. But this invention is not confined in said embodiments. The technicians who are familiar with this field can make alternatives or replacements without violating the spirits of this invention. These alternatives or replacements are contained in the scope that the claims of this invention present.

The invention claimed is:

1. An electric organ with free-combined keys, characterized in that:

it comprises a host processor and several key groups;

wherein, the key groups comprise several keys, a first interface that provides access to host processor or previous key group and a second interface that provides access to next key group;

wherein the first interface comprises a first port and a first I2C bus interface;

the second interface comprises a second port and a second I2C bus interface;

wherein, the first port and the second port connect to sub-processors, the first I2C bus interface connects to sub-processor and the second I2C bus interface respectively;

wherein the first port is used to access to the second port of previous key group or host processor; and wherein the first I2C bus interface is used to access to the second I2C bus interface of previous key group or the host processor;

wherein the second port comprises:

a transmitting terminal;

a receiving terminal;

wherein the transmitting terminal and the receiving terminal are configured to:

short when no key group is connected to the second port; and disconnect when there is a key group connected to the second port;

wherein the disconnected transmitting terminal and disconnected receiving terminal respectively connect to a transmitting terminal and a receiving terminal of a previous key group; and wherein the host processor is configured to send instructions including group number information to the key group connected to the host processor via a port line.

2. The electric organ with free-combined keys as claimed in claim 1, characterized in that: the key groups also comprise sub-processors and the keys are connected with these sub-processors and these sub-processors are connected to the host processor or previous key group via the first interface.

3. The electric organ with free-combined keys as claimed in claim 1, characterized in that: it also comprises an audio input and output module; wherein, the audio input and output module includes an audio input interface, a power amplifier circuit and speakers; wherein, the output of power amplifier circuit access to speakers; the output of the audio input interface access to the input of the power amplifier circuit, the output of host processor access to input of power amplifier circuit.

4. The electric organ with free-combined keys as claimed in claim 2, characterized in that: the key groups each comprise at least one LED module; wherein, the LED module comprises an LED driver and LED lights, the output of sub-processor connects to the LED driver and LED lights.

5. The electric organ with free-combined keys as claimed in claim 1, characterized in that: it also includes a power supply module for the electric organ.

6. The electric organ with free-combined keys as claimed in claim 1, characterized in that: it also includes a Bluetooth module; wherein, the Bluetooth module connects to the host processor.

7. A method to realize free combination of electronic organ keys of an electric organ with free-combined keys comprising a host processor and several key groups, wherein the key groups comprise several keys, a first interface that provides access to a host processor or a previous key group, and a second interface that provides access to a next key group, the method including the following steps:

connecting freely combined key groups to the electronic organ;

obtaining the number of the key groups, address information and locations of keys in key groups by the host processor; and setting the function or scale for each key according the number of key groups, address information and locations of keys in key groups by the host processor; wherein the host processor sends instructions including group number information to the key group connected to the host processor via a port line;

after the key group connected to the host processor receives the instruction from the host processor, the key group connected to the host processor adds a value of 1 to the number information to create a modified number information and sends the modified number information to a subsequent key group, and each subsequent key group adds the value of 1 to the modified number information received from a previous key group and sends said number information to a further subsequent key group until reaching the last key group;

the last key group recognizes itself as the last key group, then replies its group number to the immediately previous key group;

every key group replies to the previous key group with the instruction with group number information indicating the number of the last key group; and at last, the host processor receives the instruction with the group number information indicating the number of the last key group in order to recognize the number of key groups that are connected to the electric organ.

8. The method to realize free combination of electronic organ keys as claimed in claim 7, wherein:

the host processor obtains key group number information via the ports; and the host processor obtains the key group address information and key location in the key group via an I2C bus.

* * * * *